United States Patent [19]

Naka

[11] Patent Number: 4,486,987

[45] Date of Patent: Dec. 11, 1984

[54] STAIR NOSING

[75] Inventor: Hiromitsu Naka, Yashio, Japan

[73] Assignee: Kabushiki Kaisha Naka Gijutsu Kenkyusho, Hokkaido, Japan

[21] Appl. No.: 450,548

[22] Filed: Dec. 16, 1982

[30] Foreign Application Priority Data

Dec. 18, 1981 [JP] Japan ..... 56-188074[U]

[51] Int. Cl.[3] ..... E04F 11/16

[52] U.S. Cl. ..... 52/179; 52/716

[58] Field of Search ..... 52/179, 716

[56] References Cited

U.S. PATENT DOCUMENTS 3,835,481 9/1974 Engelhart et al. ..... 52/179 X

FOREIGN PATENT DOCUMENTS 222295 6/1959 Australia ..... 52/179
0011470 5/1980 European Pat. Off. ..... 552/179
957345 1/1957 Fed. Rep. of Germany ..... 52/179
709700 5/1931 France ..... 52/179

*Primary Examiner*—J. Karl Bell
*Attorney, Agent, or Firm*—Wenderoth, Lind & Ponack

[57] ABSTRACT

A stair nosing is constituted by a flat frame for lying on a tread of a stair, a non-skid flat tire-like sheet adapted to be snappedly engaged to the flat frame and a tongue-shaped protector for the engaging portion of the flat sheet frame and the non-skid flat sheet. The non-skid flat sheet includes a connecting plate of rigid synthetic resin having a flange with a rib at one edge and a non-skid flat tread of flexible synthetic resin integrally formed on the upper surface of the connecting plate. The tongue-shaped protector is integrally formed with the non-skid flat tread so as to cover the engaging portion of the frame sheet and be spaced from a riser of the stair when the non-skid flat sheet is secured to the flat sheet frame.

6 Claims, 4 Drawing Figures

STAIR NOSING

BACKGROUND OF THE INVENTION

This invention relates to a nosing for being installed on a stair, and especially to an improved stair nosing comprising a flat frame (base sheet) for being secured on the stair and, a flat sheet for being snapped into engagement with the flat frame.

In a conventional stair nosing, an engaging portion of the flat frame and the non-skid flat sheet is located adjacent to the nose of the stair on the riser. Therefore the engaging portion may be broken and disengaged by foot pressure or impact of a shoe. Also dust can accumulate in the engaging portion.

SUMMARY OF THE INVENTION

Therefore, one object of the present invention is to provide a stair nosing which protects an engaging portion of a snappedly engagable flat frame (base sheet) and non-skid flat sheet from foot pressure or the impact of a shoe, avoids the damage or breakage of the engaging portion by foot pressure or the impact of a shoe, prevents the disengagement of the engaging portion, and protects the engaging portion from accumulating dust and the damage cused by dust.

Another object of the present invention is to provide a stair nosing which heightens the cushioning and non-skid effects thereof, protects the engaging portion by a cushioning means without being obstructive to travel up and down the stairs, and softens the foot pressure or impact of shoe upon the engaging portion.

The invention meets these objectives and overcomes the above drawbacks of prior stair nosings by providing a non-skid flat tire-like sheet comprising a connecting plate of rigid synthetic resin snappedly engagable with a flat frame (base sheet) and a non-skid tread of flexible synthetic resin integrally formed on the upper surface of the connecting plate, and a tongue-shaped protector of flexible synthetic resin which is integrally formed with one edge of the non-skid tread so as to cover the engaging portion of the non-skid flat sheet and the flat frame when the non-skid flat sheet is snappedly engaged with the flat frame. Further, in accordance with the invention the tongue-shaped protector covers the engaging portion so as to form a clearance for the engaging portion.

BRIEF DESCRIPTION OF THE DRAWINGS

The above and other objects and attendant advantages of the present invention will be more readily apparent to those skilled in the art from the following description when read in connection with the accompanying drawings, in which.

DETAILED DESCRIPTION OF THE INVENTION

Figure 1:
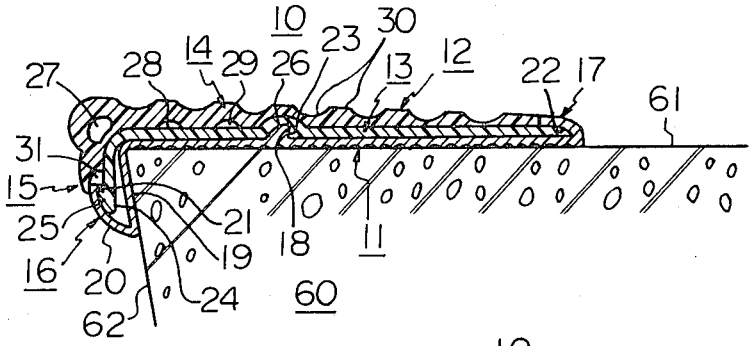
FIG. 1 is a cross-sectional view of a preferred embodiment of the stair nosing of the invention, showing the stair nosing installed on a stair.
Figure 2:
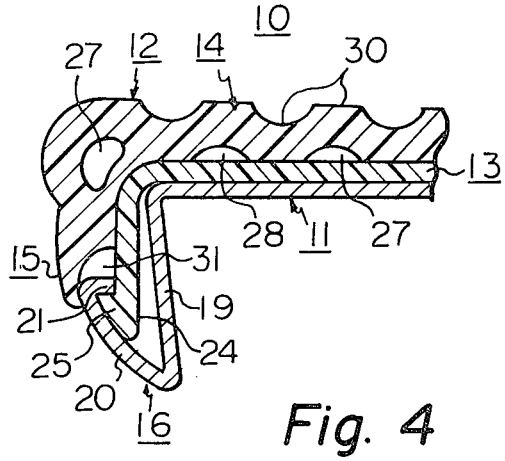
FIG. 2 is an enlarged cross-sectional view of the stair nosing as shown in FIG. 1.

The present invention will be now described referring to the accompanying drawing and more particularly, to FIGS. 1 and 2 in which the first embodiment of the stair nosing constructed in accordance with the present invention is shown.

FIGS. 1 and 2 show a stair nosing 10 of the invention, installed on a stair of a building.

The stair nosing 10 comprises a flat frame or base sheet 11 for being secured on a tread of the stair, a non-skid flat tire-like sheet 12 firmly secured to the flat frame 11 by snapped engagement, and a tongue-shaped protector 15 for covering the engaging portion of the flat frame 11 and the non-skid flat sheet 12.

The flat frame 11 is made by extrusion of aluminum alloy so as to form a hook 16 at one edge, an inturned bead 17 at the other edge and a rib 18 longitudinally extended and projected thereon.

The hook 16 has an L-shaped cross section, comprising a riser portion 19 bent downwardly from one edge of the flat frame 11 so as to project on the undersurface of the flat frame 11 so that it may be positioned on the riser 62 of the stair 60, a hook angle portion 20 bent upwardly from the lower edge of the riser portion 19 so as to be positioned at the front side of the riser portion 19, and a hook lip 21 bent toward the riser portion 19 from the upper edge of the hook angle portion 20.

The inturned bead 17 has a groove 22 in order to receive the edge of the non-skid flat sheet 12.

The rib 18 has an abutting surface 23 inclined toward the inturned bead 17.

The non-skid flat sheet 12 comprises a connecting plate 13 of rigid synthetic resin and a non-skid flat tread 14 of flexible synthetic resin integrally formed on the upper surface of the connecting plate 13.

The connecting plate 13 has a flange 24 with rib 25 at one edge. The other edge of the connecting plate 13 may be inserted in the inturned bead 17.

The flange 24 with rib 25 is bent downwardly from one edge of the connecting plate 13 so as to project on the undersurface of the connecting plate 13. The rib 25 projected toward the front side of the connecting plate 13 can be snappedly engaged with the hook 16. Naturally, the flange 24 is formed at the edge of the connecting plate 13 in order to snap smoothly into the hook lip 21 when the rib 25 and the hook lip 21 are snappedly engaged with each other. In other words, the flange 24 is formed at the edge of the connecting plate 13 so as to be spaced from the riser portion 19 of the hook 16 when the non-skid flat sheet 12 is firmly secured to the flat frame 11.

The connecting plate 13 has a longitudinal groove 26 on the undersurface thereon, for receiving the rib 18, complementary to the abutting surface 23 of the rib 18 when the non-skid flat sheet 12 is firmly secured to the flat frame 11.

The non-skid flat tread 14 is made by extrusion of flexible synthetic resin so as to have the cross section shown in FIG. 1. The non-skid flat tread 14 has a plurality of longitudinal hollow portions 27, 28 and 29 properly spaced at the flange end thereof in order to provide an excellent feel cushioning effect. Also, the non-skid flat tread 14 has a non-skid upper surface 30 in order to heighten the non-skid effect.

The tongue-shaped protector 15 is integrally formed with the non-skid flat tread 14 of flexible synthetic resin.

The tongue-shaped protector 15 extends downwardly from the front edge of the non-skid flat tread 14 so as to cover closely the engaging portion of the hook 16 and the rib 25 when the non-skid flat sheet 12 is secured to the flat sheet frame 11.

The shape of the tongue-shaped protector 15, as shown in FIG. 2, is predetermined so as to provide a clearance 31 for the engaging portion when the non-skid flat sheet 12 is secured to the flat frame 11.

Since the shape is predetermined like this, the tongue-shaped protector 15 protects the engaging portion from dust and prevents deterioration caused by dust.

Since the tongue-shaped protector 15 has a shape to provide the clearance 31, the flange 24 with rib 25 of the non-skid flat tire 12 can be easily into engagement within the hook 16 of the flat frame 11, the elastic deformation of the non-skid flat tread 14 resulting from the application of a foot to the front edge thereof is absorbed as applying foot pressure to the front and the foot pressure will not be transmitted to the engaging portion of the flange 24 and the hook 16, whereby the clearance 31 prevents the disengagement of the flange 24 from the hook 16.

In installing of a stair nosing 10 constructed as mentioned above, the stair nosing 10 would have been previously cut in length suitable for the width of the stair 60. The flat frame 11 and the non-skid flat sheet 12 are separated each other. An adhesive agent is then applied on the undersurface of the flat tire frame 11.

Then, the flat frame 11 is set on the tread 61 of the stair 60 so as to be hooked to the riser 62 of the stair 60, and the flat tire frame 11 is pressed down on the tread 61.

After the flat frame 11 is so secured on the tread 61, the rear edge of the connecting plate 13 is inserted into the groove 22 of the inturned bead 17, and the flange 24 at the front edge of the connecting plate 13 is pressed together with the hook 16 so as to engage the rib 25 snappedly in the lip 21 of the hook 16. Therefore, the non-skid flat tread 14 is firmly secured to the flat frame 11.

Thus, the stair nosing 10 can be easily and rapidly installed on the stair 60. Also, the stair nosing 10 may be nailed onto the stair 60 without using the adhesive agent.

After the stair nosing 10 is installed on the stair 60, a screw driver can be used in order to remove the non-skid flat sheet 12 from the flat frame 11. By pressing the flange 24 toward the riser 62, with the screw driver, the rib 25 is disengaged from the lip 21 of the hook 16. Thus, the non-skid flat sheet 12 can be easily and rapidly removed from the flat frame 11.

The flat frame 11 of the stair nosing 10 is described above as made of aluminum alloy, but the flat frame 11 may be made of stainless steel, rigid synthetic resin, or other suitable materials.

Figure 3:
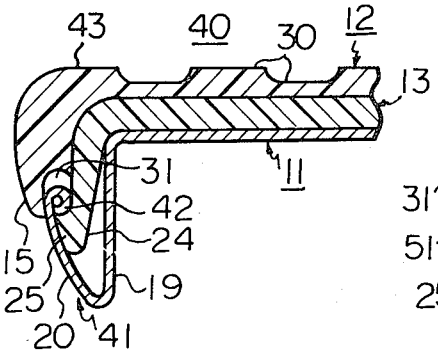
FIG. 3 is a cross-sectional view of a modified embodiment of the stair nosing of the present invention.
Figure 4:
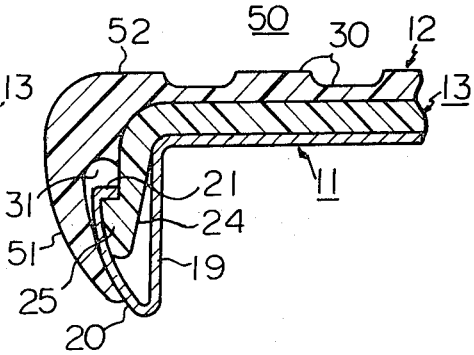
FIG. 4 is a cross-sectional view of another modified embodiment of the stair nosing in accordance with the present invention.

FIGS. 3 and 4 show modified embodiments 40 and 50 of the invention. In a stair nosing 40 as shown in FIG. 3, a lip 42 of a hook 41 is a modification of the lip 21 of the above-described stair nosing 10. The lip 42 of the hook 41 has a semi-circular cross section.

In a stair nosing 50 as shown in FIG. 4, a tongue-shaped protector 51 is a modification of the tongue-shaped protector 15 of the above-described stair nosing 10. The tongue-shaped protector 51 is longer than that of the stair nosing 10 so as to cover the angle portion 20 of the hook 16. Therefore, the tongue-shaped protector 51 can protect the hook 16 from foot pressure or the impact of a shoe, and heighten cushioning effect.

In the stair nosings 40 and 50 as shown in FIGS. 3 and 4, non-skid flat treads 43 and 52 are modifications of the non-skid flat tread 14 of the above-described stair nosing 10.

While various embodiments of the invention have been shown and described in detail, it will be understood that these are for the purpose of illustration purpose only and are not to be taken as a definition of the scope of the invention, reference being had for this purpose to the appended claims.

What is claimed is:

1. A stair nosing, comprising:

a flat metal frame for being secured to the tread of a stair, said frame including a flat upper portion having a frame front edge and a frame rear edge, a hook extending downward from said frame front edge for engaging the riser of the stair, and an inturned bead integrally formed at said frame rear edge;

a non-skid sheet including a rigid synthetic resin connecting plate for being secured to and over said frame, said plate having a sheet rear edge or insertion into said inturned bead, and a sheet front edge, a flange extending downwardly from said sheet front edge and having a flange rib snappedly engagable into said hook, and a non-skid tread having a tread front edge, formed of flexible synthetic resin, fixed on the upper surface of said connecting plate; and a tongue-shaped protector formed of flexible synthetic resin, integrally formed with said tread at said tread front edge so as to cover the engaging portions of said hook and said flange rib when said flange rib is snappedly engaged into said hook.

2. A stair nosing as in claim 1, wherein said hook includes a first hook portion extending downwardly from said frame front edge and a second hook portion extending forwardly and upwardly from the lowermost end of said first hook portion, said second hook portion having a rearwardly extending lip for snappedly engaging said flange rib.

3. A stair nosing as in claim 1, wherein said tongue-shaped protector comprises means for providing a clearance between said engaging portion and said protector while said flange rib is being snappedly engaged into said hook.

4. A stair nosing as in claim 1, wherein said flange is shaped so to be spaced from the portion of said hook which is engagable with the riser, when said flange rib is snappedly engaged in said hook.

5. A stair nosing as in claim 1, further comprising a longitudinally extending upwardly projecting frame rib formed on the upper surface of said frame, said frame rib having an abutment surface inclined toward said inturned bead, the lower surface of said connecting plate having a longitudinally extending groove for receiving said frame rib.

6. A stair nosing as in claim 1, wherein said tread includes a hollow portion adjacent to and extending generally parallel to said tread front edge.

* * * * *